United States Patent [19]

Sguazzin

[11] Patent Number: 4,493,117

[45] Date of Patent: Jan. 15, 1985

[54] CONTINUOUSLY DEODORIZED TOILET

[76] Inventor: Aldo Sguazzin, 115 Aspen Rd., Mastic Beach, N.Y. 11951

[21] Appl. No.: 510,558

[22] Filed: Jul. 5, 1983

[51] Int. Cl.[3] ..... E03D 9/04

[52] U.S. Cl. ..... 4/213; 4/211

[58] Field of Search ..... 4/213, 211, 215, 216, 4/217; 137/854, 852, 843

[56] References Cited

U.S. PATENT DOCUMENTS

| | | | |
|---|---|---|---|
| 1,191,628 | 7/1916 | Trinks | 137/854 X |
| 1,401,091 | 12/1921 | Lucas | 4/213 |
| 1,634,949 | 7/1927 | Valley | 137/854 X |
| 1,861,501 | 6/1932 | Lowther | 4/213 |
| 1,931,052 | 10/1933 | Baither | 4/213 |
| 1,956,521 | 4/1934 | Ball | 137/854 |
| 2,009,054 | 7/1935 | Mooney | 4/213 |
| 2,277,165 | 3/1942 | Stebbing et al. | 4/213 |
| 2,747,201 | 5/1956 | Herriott | 4/213 |
| 3,059,244 | 10/1962 | Jarrett | 4/213 |
| 3,287,743 | 11/1966 | Coates | 4/213 |
| 3,295,147 | 1/1967 | Meyer | 4/213 |
| 3,416,167 | 12/1968 | Klemme | 4/217 |
| 3,501,784 | 3/1970 | Maisch | 4/217 |
| 3,571,823 | 3/1971 | Lundberg | 4/213 |
| 4,054,152 | 10/1977 | Ho et al. | 137/854 X |
| 4,125,906 | 11/1978 | Weiland | 4/213 |

*Primary Examiner*—Henry K. Artis

*Attorney, Agent, or Firm*—Leonard Belkin

[57] ABSTRACT

A deodorizer for a toilet employing a compact motor housing for drawing odor laden gases from the interior of a toilet when in use and venting those gases. The motor housing is a compact device which includes a one-way valve and a motor-driven fan. In one embodiment the housing is located on the toilet and is readily removable. In another embodiment the housing is located away from the toilet and an air intake device is located on the bowl beneath the seat.

2 Claims, 7 Drawing Figures

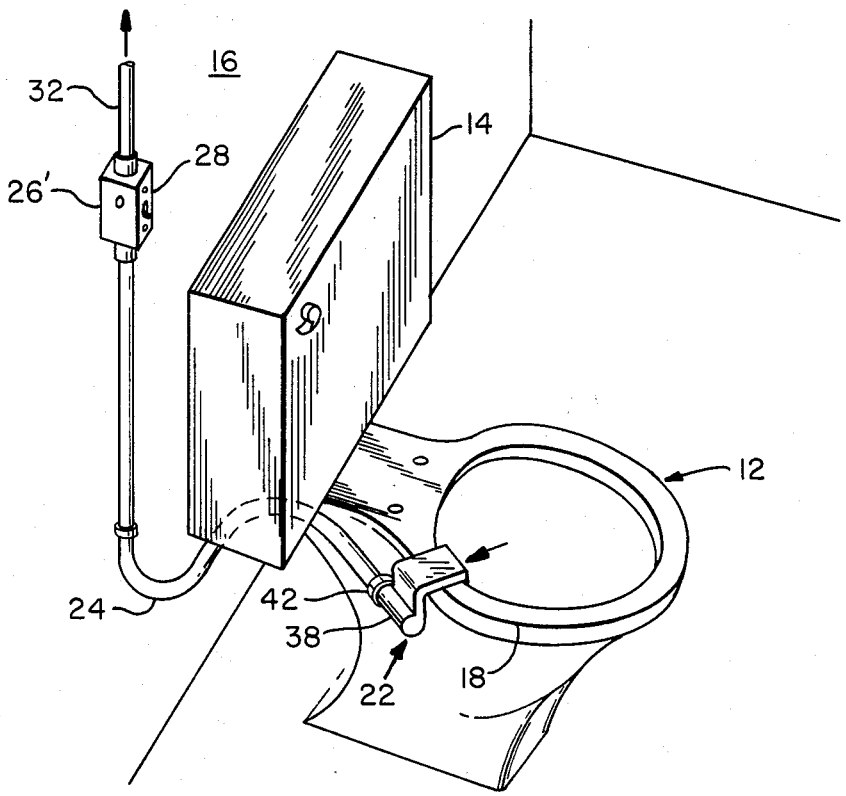
FIG. 1
FIG. 3
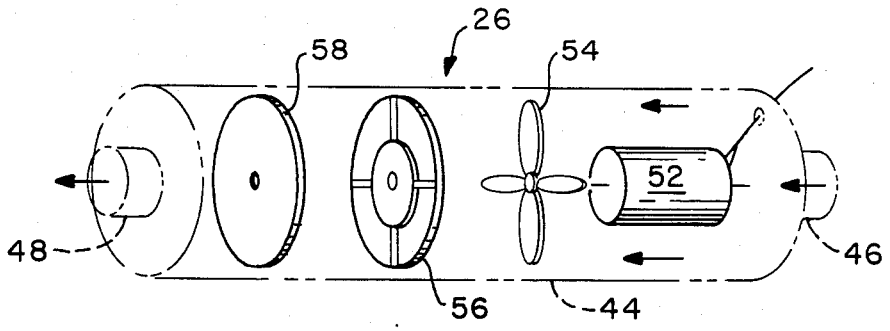
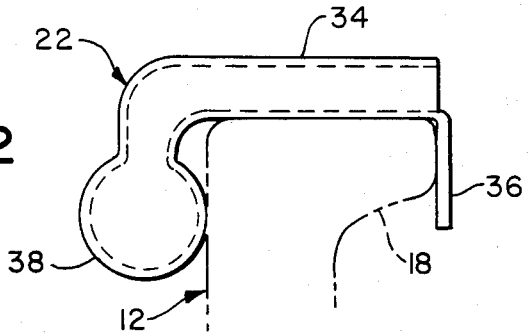
FIG. 2
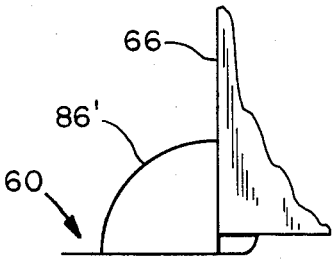
FIG. 7

FIG. 4
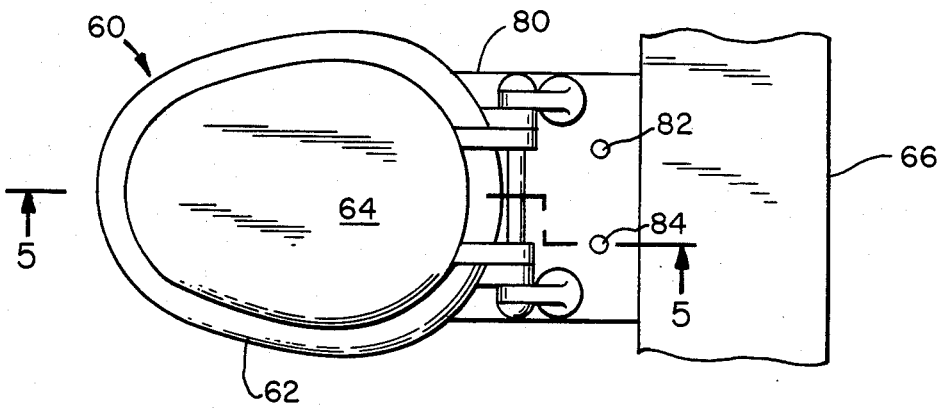
FIG. 5
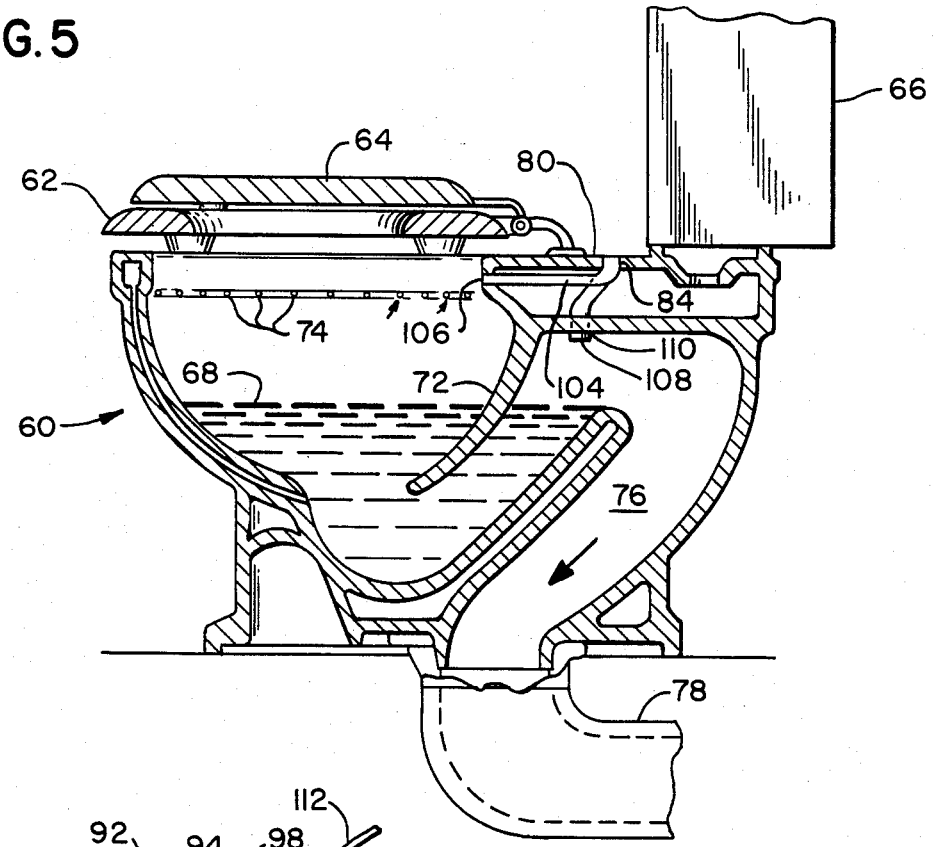
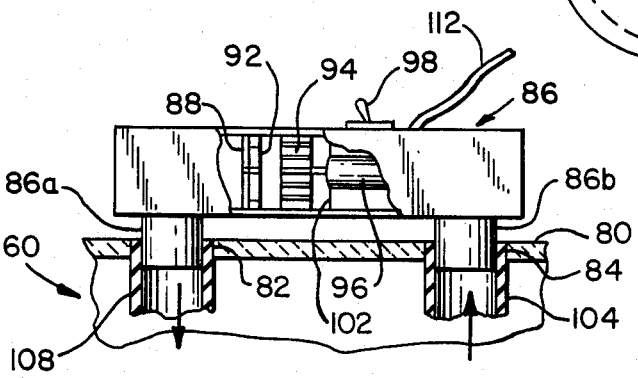
FIG. 6

CONTINUOUSLY DEODORIZED TOILET

BACKGROUND OF THE INVENTION

This invention relates to apparatus for continuously deodorizing a toilet and more particularly to readily installable deodorizing apparatus in which positive flow venting is employed to carry away objectionable odors from a toilet.

The removal of objectionable odors from a toilet has long been of interest. Venting of the bathroom, both passive and positive, is typical of the approach in current use to accomplish this goal. However, it is well understood that while this does permit the removal of much of the objectionable odors, it is not completely effective.

To improve the rate of odor removal, attempts have been made to remove the odor laden gases directly from their source, that is, the toilet. Devices for accomplishing this are shown in U.S. Pat. Nos. 3,273,170, 3,335,431, 3,805,704, 3,939,506 and 4,133,060. The arrangements shown in these patents suffer from a variety of disadvantages and drawbacks. They are all complex in construction and most require extensive modification of the toilet itself. In some of them the electric motors are situated in places where flooding of the toilet, a not unusual occurrence, could result in damage to the motor. None of them appears to be able to be packaged and merchandised as a kit for installing readily on an existing toilet.

SUMMARY OF THE INVENTION

The present invention overcomes many of the disadvantages and drawbacks of present arrangements for evacuating odor laden gases from a toilet by providing, in one preferred embodiment, a construction readily useful with any existing toilet. In this preferred embodiment there is provided a hollow member which snaps over the rim of the toilet under the seat having an opening into the toilet. The hollow member has a hose connection on the outside of the toilet and a hose or other conduit connected thereto. A housing mounted above the toilet in any convenient location is connected to the hose. The housing contains a fan driven by an electric motor and a normally closed valve located downstream of the fan. A hose carries the odor laden gases from the housing and a switch is provided to control the operation of the motor. The embodiment as just described can be packaged as a kit to be used with any toilet already installed without modification of the toilet.

In another preferred embodiment of this invention, a toilet is provided which incorporates features for the removal of odor laden gases. In this arrangement, two holes in the toilet at seat level are provided for accommodating the housing as described above. One hole is the inlet for the gases and the other accommodates a hose connection to vent the gases. A principal feature of this embodiment is that the motor housing is above the level of the toilet so that there is no danger that flooding could damage the units.

It is thus the principal object of this invention to provide apparatus for the removal of odor laden gases from a toilet.

Other objects and advantages of this invention will become obvious from the following description of preferred embodiments of this invention.

BRIEF DESCRIPTION OF THE DRAWINGS

FIG. 1 is a perspective view of a preferred embodiment of this invention installed on a toilet.

FIG. 2 is a side view of the air inlet housing.

FIG. 3 is an exploded view of the interior of the motor housing partially schematized.

FIG. 4 is a plan view of a toilet incorporating a deodorizer in accordance with the principles of this invention.

FIG. 5 is a view along 5—5 of FIG. 4.

FIG. 6 is an elevation view partially cut away of the motor housing installed in the toilet shown in FIGS. 4 and 5.

FIG. 7 shows the side view of an installed housing with an alternative shape.

DESCRIPTION OF THE PREFERRED EMBODIMENTS

Referring to FIG. 1, there is illustrated a toilet 12 with a tank or water closet 14 mounted up against a wall 16 in a bathroom. Toilet 12 is shown with its rim 18 exposed and the seat removed.

The preferred embodiment illustrated consists of an air inlet housing 22, a hose 24, a motor housing 26 within an enclosure 26', switch 28, and a hose 32.

As also seen in FIG. 2, air inlet housing 22 is hollow and consists of a main section 34 which is rectangular in cross section, a flap 36, and a cylindrical section 38 having an extension 42 to permit attachment to hose 24. Flap 36 and housing 22 may be of metal or plastic construction.

When housing 22 is placed on rim 18 of toilet 12 as shown in FIG. 2, flap 36 may be bent inwardly to hold housing 22 in place. The latter could be covered when the seat (not shown) is lowered onto rim 18. As is understood in the art, a seat is provided with legs and the depth of main section 34 is sufficiently shallow to fit within the space between the seat and rim 18.

Motor housing 26, as also seen in FIG. 3, consists of a main body 44 and hose connections 46 and 48 to attach to hoses 24 and 32, respectively. Within main body 44 are an electric motor 52 connected to drive fan 54 and a grid 56 for supporting a rubber flap 58 connected at its center to grid 46. Grid 56 and flap 58 together constitute a one-way valve known in the art. When motor 52 is energized, driving fan 54, air flows under pressure through grid 56 and bends rubber flap 58 to permit flow in this direction. When motor 52 is deenergized, flap 58 returns to its normal position against grid 56 thereby preventing any flow back. Motor 52 is supported to permit gas flow past it as shown by the arrows. Switch 28 is used to turn motor 52 on and off. Hose 32 directs the exhaust from motor housing 26 out of the bathroom, typically outside the building, or to a vent within the house or building.

In using the apparatus just described, it is understood that housings 22 and 26, switch 28 with associated electrical wiring, and hoses 24 and 32 may be assembled into a kit for distribution and sale. Installation is very simple. Air intake housing 22 is simply mounted on rim 18 of toilet 12 and flap 36 bent down to hold it in place. Motor housing 26 may be placed anywhere as long as it is above toilet 12 to avoid being damaged in the event of overflowing. It can be located either on or inside wall 16 with switch 28 exposed. Hose 32 can be located wherever convenient. When toilet 23 is being used, motor 52 is energized, and turned off when not in use. It has been found that with this apparatus installed and used as described there are no detectable odors when toilet 12 is in use. Motor 52 may be driven by 110 volts, a low voltage from a transformer, or a battery. It has been found that gas flow as low as 5–10 cf/min is sufficient to deodorize the toilet.

Under some circumstances it may be desirable to construct a toilet with the deodorizer incorporated, or to modify an existing toilet with this feature. Another embodiment of this invention capable of such use is illustrated in FIGS. 4, 5, and 6. Toilet 60 is of conventional design with seat 62, cover 64, water tank 66, and a bowl 72 which contains a reservoir 68 of water. When toilet 60 is flushed, water from tank 66 enters bowl 72 through openings 74 and is flushed out through area 76 out sewer drain 78. Except when toilet 60 is being flushed, area 76 is free of all liquid as indicated by the level of reservoir 68.

On the top surface 80 of toilet 60 are provided a pair of spaced openings 82 and 84. As shown in FIG. 6, a motor housing 86 is provided with connectors **86*a* and 86*b* which are plugged into these openings. Housing 86 may be cylindrical in cross section and contains rubber diaphragm 88 mounted on grid 92, and a fan 94 driven by electric motor 96 controlled by a switch 98 on the outside of housing 86. Motor 96 is supported in the center of housing 86 by struts 102 to permit flow of gases therethrough. As explained in connection with FIG. 3, diaphragm 88 acts as a one-way valve in the direction of the arrows, blocking any flow of gases or liquid in the reverse direction. Housing 86 may be within a curved enclosure 86' as shown in FIG. 7 which may be more sanitary and easier to clean, being flush against water tank 66. Also, such a shape accommodates pivoting of seat 62 and cover 64**.

Referring back to FIGS. 4, 5, and 6, it will be seen that a hose 104 connects opening 84 to an opening 106 into bowl 72. A hose 108 connects opening 82 to space 76 through an opening 110. Thus, when motor 96 is energized, gases are drawn from inside bowl 72 through hose 104 into housing 86, out through hose 108 into space 76. An electric cord 112 for operation of motor 96 may be placed wherever convenient for connection with a source of either 110 volts, a low voltage through a step down transform conveniently located, or a battery (not shown) built into housing 86.

The location of housing 86 above the top of toilet 60 is an important feature of the invention as overflowing or flooding will not damage the device. Another feature of the invention is the easy removal of housing 86 for repair, maintenance, or replacement. Simple caps to cover holes 82 and 84 maybe employed when it is decided not to use the device. It should also be noted that if desired hose 108 instead of being connected to discharge into space 76 may extend out through toilet 60 to vent directly outside of the room.

It is thus seen there has been provided a simple and reliable arrangement to deodorize continuously a toilet while in use. While only certain preferred embodiments of the invention have been described and illustrated it is understood that many variations of this invention are possible without departing from the principles of this invention as defined in the claims which follow.

What is claimed is:

1. In a toilet having a bowl with a reservoir of water, a water closet, a region communicating with a sewer drain, and a top surface on said bowl supporting a pivoted seat, the improvement comprising a pair of spaced holes in said top surface adjacent said reservoir, a first conduit communicating the first of said holes with the interior of said bowl above the level of said reservoir, a second conduit communicating the second of said holes with said region, motor housing means mounted on said top surface, said housing means containing normally closed valve means for permitting flow of gases in only a forward direction and blocking flow of gases and liquid in the reverse direction, a fan, and a motor for driving said fan to direct flow through said valve in said forward direction, said valve means consisting of a flexible rubber diaphragm mounted on the downstream side of a grid the latter being bendable from its center and attached to said grid to allow flow of gases in one direction only, said housing means having electrical switch means for controlling operation of said motor, said housing means having connectors for insertion in said holes so that flow from said first conduit to said second conduit is in the forward direction through said housing means whereby when said motor is energized while said toilet is in use, odor laden gases are continuously evacuated from the interior of said bowl, said housing means being readily removable by pulling said connectors out of said holes.

2. In the toilet of claim 1 said housing means having one side flush against said water closet and another side curved to accommodate movement of said seat.

* * * * *